United States Patent [19]

Aguet

[11] 4,136,643

[45] Jan. 30, 1979

[54] WASTE HEAT STEAM GENERATOR

[75] Inventor: Emile Aguet, Winterthur, Switzerland

[73] Assignee: Sulzer Brothers Limited, Winterthur, Switzerland

[21] Appl. No.: 824,693

[22] Filed: Aug. 15, 1977

[51] Int. Cl.[2] ..... F22B 1/18; F22B 31/04; F22G 5/06

[52] U.S. Cl. ..... 122/7 B; 122/240 R; 122/479 B

[58] Field of Search ..... 122/7 R, 7 B, 240 R, 122/240 A, 240 B, 479 A; 110/204, 205

[56] References Cited

U.S. PATENT DOCUMENTS

| | | | |
|---|---|---|---|
| 1,925,646 | 9/1933 | Rakestraw | 122/7 |
| 2,867,195 | 1/1959 | Hauck et al. | 122/240 |
| 3,153,402 | 10/1964 | Danko et al. | 122/7 |
| 3,884,193 | 5/1975 | Bryers | 122/7 |

*Primary Examiner*—Kenneth W. Sprague
*Attorney, Agent, or Firm*—Kenyon & Kenyon, Reilly, Carr & Chapin

[57] ABSTRACT

The waste heat steam generator employs two parallel channels for receiving flows of exhaust gas from a gas turbine. In one channel, the exhaust gas flow is heated by a supplemental burner to a temperature less than 900° C while the flow of exhaust gas in the second channel is heated to a temperature above 900° C. The amount of fuel supplied to each burner is controlled by various control means responsive to the temperature within the steam generator or the temperature of the live steam or by the pressure of the live steam. A distribution means is provided at the entrance to the channel in which the exhaust gas is heated to a temperature above 900° C so as to control the flow therein. The steam generator can be easily adapted to partial load operation by regulating the amount of fuel to the supplemental burners.

12 Claims, 1 Drawing Figure

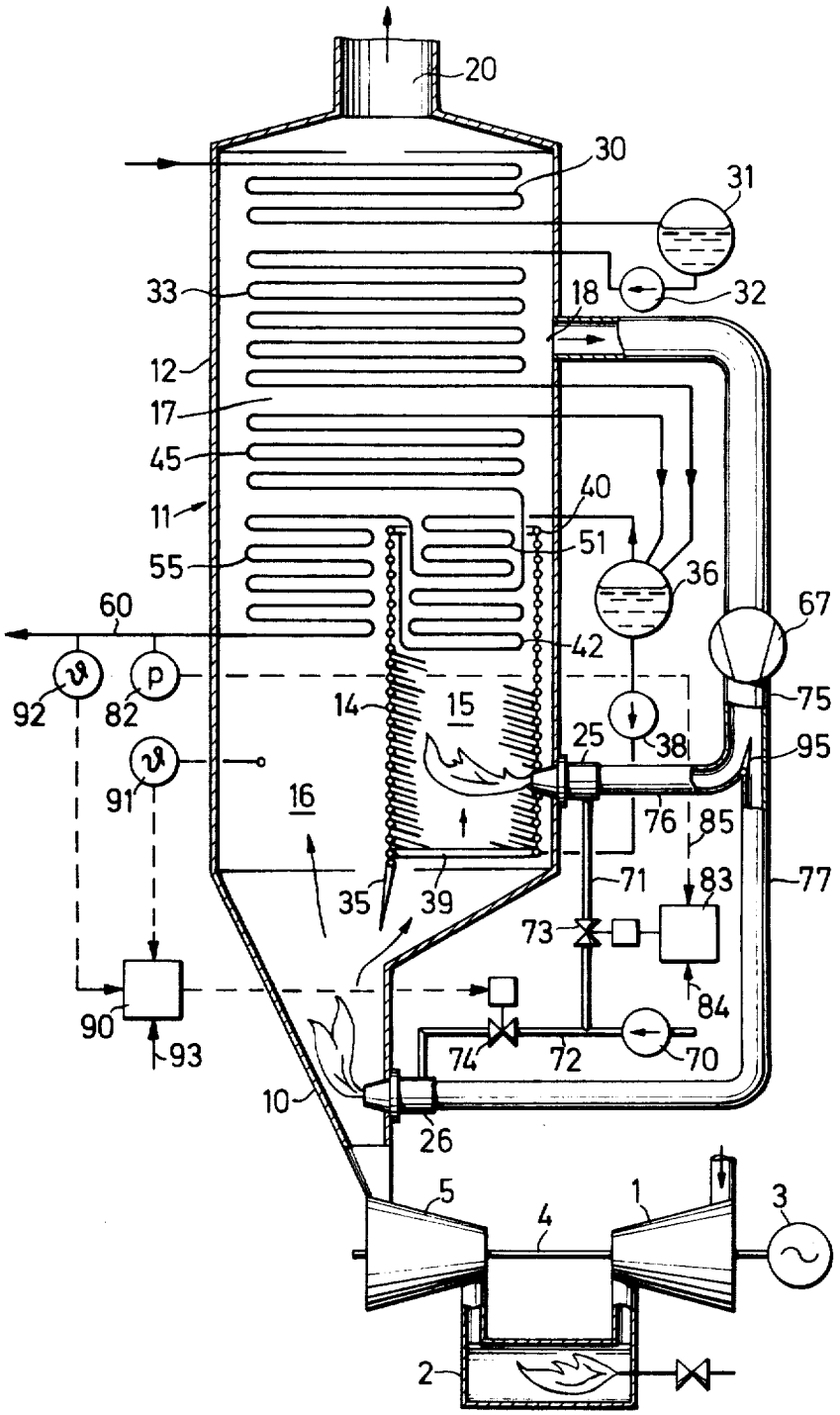
20
30
31
33
18
32
12
17
45
40
11
51
55
36
60
67
42
92
82
P
14
15
75
25
38
95
91
16
76
85
35
39
71
83
77
73
84
90
93
74
72
70
10
26
5
4
1
3
2

WASTE HEAT STEAM GENERATOR

This invention relates to a waste heat steam generator and, particularly, to a waste heat steam generator for utilizing the heat contained in the exhaust gas of a gas turbine.

Heretofore, various attempts have been made to utilize the heat contained in the exhaust gas of a gas turbine by connecting a waste heat steam generator to the gas turbine exhaust. However, these attempts have either required relatively high investment costs or have been unable to cope with partial-load operation in a simple manner.

Accordingly, it is an object of this invention to provide a waste heat steam generator which is easily adaptable to partial-load operation in a simple manner.

It is another object of the invention to provide a waste heat steam generator which requires relatively low investment costs for use with a gas turbine.

Briefly, the invention provides a waste heat steam generator which comprises a pair of channels disposed in parallel relation relative to a flow of exhaust gas and various heating surfaces and supplemental burners in the channels. In particular, the steam generator has an entrance for receiving a flow of exhaust gas with the channels disposed downstream of the entrance. In addition, at least one heating surface is disposed in each channel for conveying a working medium therein in heat exchange relation with a flow of exhaust gas in the channel. In addition, a first supplemental burner is disposed in one of the channels to heat a flow of exhaust gas therein to a temperature above 900° C. Similarly, a second supplemental burner is disposed between the entrance and the heating surface of the other channel to heat a flow of gas therein to a temperature less than 900° C.

In one embodiment, the second supplemental burner can be disposed upstream of the channels relative to the flow of exhaust gas in order to heat the entire flow of exhaust gas flowing from the entrance to the steam generator.

The heating surface in the first channel in which the gas can be heated to a temperature above 900° C. is in the form of an evaporator which bounds the channel while the heating surface in the other channel is a superheater. Additionally, a second evaporator and a superheater can be disposed in the first channel in series with the first evaporator relative to the flow of working medium therein. In this case, the superheater is disposed downstream of the second evaporator relative to the flow of exhaust gas.

The steam generator may also have a common channel downstream of the two channels relative to the flow of exhaust gas with at least one heating surface in the common channel for conveying a flow of the working medium in heat exchange relation with the flow of exhaust gas.

A gas distribution means may also be disposed at an entrance to the channel in which the exhaust gas can be heated above 900° C. in order to control the proportion of exhaust gas flow into this channel.

The steam generator also has a take-off point downstream of the pair of channels for removing a portion of the flow of exhaust gases as well as a means for conveying this gas from the take-off point to the first supplemental burner to supply the removed gas as combustion air to this burner.

The steam generator is also provided with various control means for controlling the respective burners. In one case, the control means is responsive to the gas temperature prevailing in the channel in which the exhaust gas is heated to a temperature less than 900° C. in order to control the burner therein. In another embodiment, the control means is responsive to the live steam temperature of the working medium exiting from the heating surface in the second channel in order to control the second burner. Alternatively, the control means may be responsive to the gas temperature prevailing in the channel as well as the live steam temperature of the working medium exiting from the heating surface in this channel in order to control the burner therein. Still further, the control means may be responsive to the live steam pressure of the working medium exiting from the heating surface in the low temperature channel in order to control the burner therein.

By subdividing the steam generator into two channels and by providing separate burners in each which can be operated independently of each other, the waste heat steam generator can be easily adapted to different loads. This is because the heat supplied to the heating surfaces in the two channels can be varied in a simple manner by influencing each of the supplemental burners.

The second supplemental burner can be arranged close to the entrance to the second channel so that the heat from the burner has an effect only on the gas stream flowing through the second channel. In general, however, it is more advantageous to arrange the second supplemental burner at the entrance of the exhaust gas into the steam generator so that the entire exhaust gas stream is heated by this burner.

The evaporator heating surface which bounds the first channel may be in the form of a wall tubing complement while the other channel has superheater surfaces which are essentially heated only by contact. This results in good thermal utilization of the material for the heating surfaces as part of the wall tubing forms the partition between the two channels and is accordingly heated from both sides. This brings about not only an increase in the effective heat transfer area but also reduces the thermal stresses in the wall tubing.

These and other objects and advantages of the invention will become more apparent from the following detailed description and appended claims taken in conjunction with the accompanying drawing in which:

The drawing illustrates a schematic view of a waste heat steam generator in accordance with the invention.

Referring to the drawing, the waste heat steam generator 11 is connected to the exhaust line of a gas turbine group so as to receive a flow of exhaust gas therefrom. As indicated, the gas turbine group consists of a compressor 1, a gas turbine combustion chamber 2, a gas turbine 5 which is coupled via a shaft 4 to the compressor 1 and an electric generator 3. The exhaust of the gas turbine 5 is connected via a connecting duct 10, which forms the entrance of the steam generator 11, to a housing 12 of the steam generator. This housing 12 is rectangular in plan view and has various heating surfaces.

In the part of the housing 12 adjoining the connecting duct 10, the steam generator is divided into two channels 15, 16 which are connected in parallel relative to the flow of exhaust gas. The first channel 15 is bounded by a well-like wall tubing 14 which is formed by tubes which are arranged on the rise and are welded together in a gas-tight manner via straps and which, starting from a plenum 39 of square outline wind their way upward about the channel 15 and terminate in a plenum 40 which is also square in plan view. The wall to the left of the drawing of the wall tubing 14 also forms a partition between the two channels 15, 16. The second channel 16 is thus bounded by the wall tubing 14 and by the sides of the housing 12 on the remaining three sides.

The first channel 15 is provided with a supplemental burner 25 which is disposed so as to heat the exhaust gas entering the channel 15 to a temperature above 900° C. Likewise, a second supplemental burner 26 is disposed in the connecting duct 10 so as to heat the entire exhaust gas stream leaving the gas turbine 5 to a temperature less than 900° C. To the extent necessary, the walls of the duct 10 and, optionally, the walls of the housing 12 bounding the channel 16 can be lined on the inside with refractory material.

The steam generator 11 also has a common channel 17 downstream of the pair of channels 15, 16 relative to the flow of exhaust gas. This channel 17 connects to a gas exhaust line 20 which leads to a stack. A feed water preheater 30 is disposed in the channel 17 at the upper end, as viewed. This preheater 30 is formed by continuous tube loops and is suspended in the housing 12 by suitable means (not shown). The outlet of the feed water preheater opens into a feed water tank 31 which is constructed in known manner and which acts as a deaerator. The tank 31 communicates with a feed water pump 32 by which feed water is fed from the tank to an economiser heating surface 33 which is likewise formed by continuous loops and is suspended in the housing 12 below the feed water preheater 30. This economizer heating surface 33 opens into a steam/water drum 36 from which the water to be evaporated is taken by means of a circulating pump 38 and fed to the plenum 39 of the wall tubing 14. The wall tubing 14 bounding the channel 15 therefore forms a first evaporating heating surface. The lower part of this evaporating heating surface is heated through radiation by the burner 25.

A second evaporator heating surface 42 is connected in series to the plenum 40 of the wall tubing 14 and also consists of several continuous tube loops arranged within the channel 15. The exit of the second evaporator heating surface 42 communicates with a third evaporator heating surface 45 which is disposed in the common channel 17 between the economiser heating surface 33 and the exit of the two channels 15, 16. This third evaporator heating surface 45 also consists of several continuous loops and opens into the steam/water drum 36.

A presuperheater surface 51 is connected to the steam space of the drum 36 and also consists of continuous loops which are disposed in the channel 15 downstream of the second evaporator heating surface 42 relative to the flow of exhaust gas. In addition, a final superheater heating surface 55 which consists of continuous tube loops is arranged in the channel 16. Live steam is formed in this final superheater surface 55 and is conducted to a steam turbine (not shown) via a live steam line 60. The heating surfaces 45, 55, 51, 42, as well as the wall tubing 14 are suspended as are the heating surfaces 30, 33 in the housing 12 of the steam generator in known manner.

In order to supply the two burners 25, 26 with fuel, a pump 70 is connected on the intake side to a fuel supply tank (not shown) and on the output side via lines 71, 72 to each burner 25, 26, respectively. In addition, a valve 73 is disposed in the line 71 and is connected via a positioning motor to a control 83. The valve 73 serves to adjust the amount of fuel flowing to the burner 25. The actual-value input of the control 83 is connected via a signal line 85 to a pressure sensor 82 connected to the live steam line 60. The set point value for the live steam pressure is fed to the control 83 via a signal line 84.

In order to adjust the amount of fuel flowing to the second burner 26, a valve 74 is disposed in the line 72 and is connected via a positioning motor to a control 90. The control 90 is fed an actual value signal either from a temperature sensor 92 in the steam line 60 or by means of a temperature sensor 91 in the channel 16. In this way, the control means can be responsive to either or both of the live steam temperature of the working medium exiting from the heating surface 55 in the channel 16 or to the gas temperature prevailing in the channel 16. The set point value for the respective temperatures are delivered to the control 90 via a signal line 93. It is possible to allow both temperatures to act simultaneously on the control 90 with one of the two measured quantities then being added as a disturbance variable.

As combustion air, gas is fed to the two burners 25, 26 from the steam generator. This gas generally has a sufficiently large oxygen content for this purpose. As indicated, the gas is taken from the steam generator from a take-off point 18 located downstream of the channels 15, 16. At this point, the exhaust gas has achieved a partially cooled down state. The gas is conveyed from the take-off point 18 to the burners 25, 26 by suitable means. For example, the means is in the form of a blower 67 which is connected to the take-off point 18 by a suitable duct and has an output line 75 which branches into two lines 76, 77 which lead to the respective burners 25, 26. A distribution device 95, such as a flap, is also provided at the branch-off point of the line 75. By appropriate positioning of this flap 95, the amount of gas flowing into the lines 76, 77 can be adjusted to the correct ratio. The total amount of gas required in the burners 25, 26 can be adjusted by controlling the speed of the blower 67.

A gas distribution means 35 in the form of a flap can also be provided in the connecting duct 10 at the entrance to the channel 15 in order to control the proportion of exhaust gas flow into the channel 15. The flap 35 allows the gas flowing to the channel 15 to be reduced to zero.

In operation, the exhaust gases from the gas turbine 5 are heated by the supplemental burner 26, to 800° C. The gas which is so heated is then distributed over the two channels 15, 16 in accordance with the position of the gas distribution means 35. Due to the heat transfer from the gas flowing in the channel 16 to the final superheater heating surface 55, the steam adjusts to a live steam temperature of about 530° C. at the outlet of the heating surface 55. Thus, a high steam turbine efficiency is achieved.

The substream of the gas entering the channel 15 is heated by means of the burner 25 to a value below 900° C. In this case, the heat is transferred to the wall tubing 14 essentially by flame radiation and to the second evaporator heating surface 42 and the presuperheating surface 51 essentially by contact. At the entrance of the gas into the second evaporator surface 42, the gas has a temperature of about 900° C. By cooling the gas down at the heating surfaces 42, 51, a gas temperature is obtained at the end of the channel 15 which is approximately equal to that at the end of the channel 16. Thus, the two gas streams enter the common channel 17 with about the same temperature where further heat is removed by the heating surfaces 45, 33, 30.

If the power of the gas turbine 5 is reduced, then the gas temperature at the exhaust gas turbine 5 drops while the amount of exhaust gas remains practically the same. If the set point value set to the control 90 via the signal line 93 is kept constant, then the fuel supply to the second supplemental burner 26 is increased because of the initial temperature drop at the sensors 91 and/or 92. Thus, the reduced temperature of the gas leaving the gas turbine 5 is compensated.

If the consumption of applied steam is reduced, this leads to a temporary rise in the live steam pressure. The fuel supply to the first supplemental burner 25 is therefore decreased via the control 83 due to the increased pressure. This reduction in the fuel supply causes a reduction in the quantity of steam produced and, thus, a temporary increase of the live steam temperature. This, in turn, leads to a reduction of the fuel supply to the second supplemental burner 26 via the control 90.

Alternatively, it is also possible to arrange the second supplemental burner 26 close to the entrance of the channel 16. In this way, the burner can then heat only part of the amount of gas leaving the gas turbine 5 while the remaining part passes directly into the channel 15. In addition, the left hand wall of the wall tubing 14 can be adjacent to a partition dividing the common channel 17. Thus, there are then two channels which extend over the length of the steam generator. Finally, the burner 26 arranged in the connecting duct 10 may be constructed as a so-called duct burner.

What is claimed is:

1. A waste heat steam generator comprising
   an entrance for receiving a flow of exhaust gas;
   a pair of channels disposed in parallel relation relative to a flow of exhaust gas downstream of said entrance;
   at least one heating surface in each said channel for conveying a working medium therein in heat exchange relation with a flow of exhaust gas in said respective channel;
   a first supplemental burner disposed in one of said channels to heat a flow of exhaust gas therein to a temperature above 900° C.; and
   a second supplemental burner disposed between said entrance and said heating surface in said other of said channels to heat a flow of exhaust gas therein to a temperature less than 900° C.

2. A waste heat steam generator as set forth in claim 1 wherein said second supplemental burner is disposed upstream of said channels relative to the flow of exhaust gas to heat the entire flow of exhaust gas flowing from said entrance.

3. A waste heat steam generator as set forth in claim 2 wherein said heating surface in said one channel is an evaporator bounding said one channel and said heating surface in said other channel is a superheater.

4. A waste heat steam generator as set forth in claim 3 which further comprises a second evaporator in said one channel connected in series with said first evaporator relative to a flow of working medium therein.

5. A waste heat steam generator as set forth in claim 3 which further comprises a superheater in said one channel connected in series with said second evaporator relative to a flow of working medium therein, said superheater being disposed in said one channel downstream of said second evaporator relative to a flow of exhaust gas therein.

6. A waste heat steam generator as set forth in claim 1 which further comprises a common channel downstream of said pair of channels relative to the flow of exhaust gas, and at least one heating surface in said common channel for conveying a flow of the working medium in heat exchange relation with the flow of exhaust gas.

7. A waste heat steam generator as set forth in claim 1 which further comprises a gas distribution means at an entrance of said one channel for controlling the proportion of exhaust gas flow into said one channel.

8. A waste heat steam generator as set forth in claim 1 which further comprises a take-off point downstream of said pair of channels for removing a portion of the flow of exhaust gas, and means for conveying the removed gas from said take-off point to said first supplemental burner to supply the removed gas as combustion air to said first supplemental burner.

9. A waste heat steam generator as set forth in claim 1 which further comprises a control means responsive to a gas temperature prevailing in said other channel for controlling said second supplemental burner.

10. A waste heat steam generator as set forth in claim 1 which further comprises a control means responsive to a live-steam temperature of the working medium exiting from said heating surface in said other channel for controlling said second supplemental burner.

11. A waste heat steam generator as set forth in claim 1 which further comprises a control means responsive to a gas temperature prevailing in said other channel and a live steam temperature of the working medium exiting from said heating surface in said other channel for controlling said second supplemental burner.

12. A waste heat steam generator as set forth in claim 1 which further comprises a control means responsive to a live-steam pressure of the working medium exiting from said heating surface in said other channel for controlling said first supplemental burner.

* * * * *